US006295961B1

(12) United States Patent
Carter

(10) Patent No.: US 6,295,961 B1
(45) Date of Patent: Oct. 2, 2001

(54) INTERNAL COMBUSTION ROTATING SPHERICAL HEAD AND VALVE

(76) Inventor: Jacob Glen Carter, 620 W. Westchester, Apt. No. 11204, Grand Prairie, TX (US) 75052

( * ) Notice: Subject to any disclaimer, the term of this patent is extended or adjusted under 35 U.S.C. 154(b) by 0 days.

(21) Appl. No.: 09/439,622

(22) Filed: Nov. 12, 1999

(51) Int. Cl.[7] ..... F02M 57/04
(52) U.S. Cl. ..... 123/190.1
(58) Field of Search ..... 123/190.1, 190.17, 123/190.14

(56) References Cited

U.S. PATENT DOCUMENTS

| | | | | |
|---|---|---|---|---|
| 908,657 | | 1/1909 | Howard . | |
| 1,079,741 | | 11/1913 | Calkins . | |
| 2,725,043 | * | 11/1955 | Bacot | 123/190.14 |
| 2,787,988 | | 4/1957 | Genet . | |
| 3,990,676 | * | 11/1976 | Brownstein | 251/175 |
| 4,467,752 | * | 8/1984 | Yunick | 123/307 |
| 5,103,778 | | 4/1992 | Usich, Jr. . | |
| 5,131,359 | | 7/1992 | Domm et al. . | |
| 5,579,734 | | 12/1996 | Muth . | |
| 5,816,203 | | 10/1998 | Muth . | |

FOREIGN PATENT DOCUMENTS

| | | | | |
|---|---|---|---|---|
| 0 092 869 | * | 11/1983 | (EP) | 123/190.1 |
| 0 342 893 | * | 11/1989 | (EP) | 123/190.1 |

* cited by examiner

*Primary Examiner*—Tony M. Argenbright
*Assistant Examiner*—Hyder Ali
(74) *Attorney, Agent, or Firm*—Henry Graskell

(57) ABSTRACT

A rotating spherical head and valve internal combustion engine includes an engine block having at least one combustion cylinder which is sealed by a rotating spherical head and valve. The rotating spherical head and valve includes an intake path opening and exhaust opening for directing intake air into the combustion chamber and for exhausting combustion gasses from the combustion chamber as the spherical head and valve rotates. In one embodiment of the invention, a spark plug and/or fuel injector are mounted in the cylinder combustion chamber for injecting and igniting fuel in each combustion chamber. The ignition can be by the sparkplug or can be by compression of the piston when fuel is injected in the combustion chamber. In a preferred embodiment, the rotating spherical head and valve mechanism allows for improved air intake and exhaust gasses outlet by 100% or more as compared to today's poppet valves.

9 Claims, 2 Drawing Sheets

INTERNAL COMBUSTION ROTATING SPHERICAL HEAD AND VALVE

FIELD OF THE INVENTION

The present invention relates to internal combustion engines and more particularly to internal combustion engines utilizing a rotating spherical head and valve for directing the flow of intake air into the cylinder, sealing the combustion chamber for the power stroke and exhausting gasses from the cylinders.

BACKGROUND OF THE INVENTION

The four stroke internal combustion engine has changed little since its inception over one hundred years ago. For an engine to produce power it needs to breath. The more air that can pump with the proper amount of fuel, the greater the specific output. The quest for air flow is not a singular pursuit by the performance industry but is also shared by the government and auto manufacturers. The continual strive for fuel efficiency has brought about introduction of smaller displacement engines in lighter weight automobiles. One reason for Japan gaining great market shares of U.S. automobiles was that they had already produced smaller cars with smaller efficient engines. However, all of the downsized automobiles still lack an improved power and acceleration. To satisfy this complaint, manufacturers used several methods to increase output while still meeting federal government meditated mileage levels. Improved methods include performance enhancing technologies through the use of larger valves, higher compression ratios, higher RPMs, more valves per cylinder, super charging and turbo charging. These efforts were mainly to improve the efficiency of the engine, its off gasses reducing the pollution of same while increasing miles per gallon of gasoline through increased airflow and exhaust flow of the engine. However, when trying to change certain design functions such as airflow through valve numbers, increasing RPMS and the like, a gain in one technological area is usually offset by restriction in another. If a cylinder head can be diminished to poor flowing status by the insulation of a low capacity intake manifold, an intake that is too large will not work with a restricted cylinder head.

It is accepted the current valve designs present the largest offender in the quest for airflow and the internal combustion four stroke engine. Poppet valve, a tulip shaped device has been used in some form or other since the first engines to the latest design models out of Detroit. It's reciprocating motion has been the standard barrier of airflow until now. In addition, airflow has been approached by various engineers through replacements of the reciprocating valve or poppet valve. One idea has been a rotating motion of a port opening in a sphere to operate the valve which reduces friction. Such an arrangement would have the valve share the same motion as a crank shaft, eliminating all of the up and down of the poppet valve.

Emissions from vehicles is an ever increasing problem for today's engine and requires design features and new breathing features which reduce same. The most efficient method to reduce emissions is to produce the production of same. In this regard, electrical vehicles may eventually prove successful, but as of now technical problems remain and these electrical vehicles will likely be costly to produce. However, reduction of emissions produced by current internal combustion engines is most effectively done by burning less fuel under controlled conditions which in turn increases efficiency of the fuel burn. As conventional poppet engines are reaching the limits of development, a change in the airflow mechanism for the internal combustion engine is the answer. While in some performance gains can be recaptured through reduced vehicle weight and other technical improvements, it is expected that the resultant vehicle will not match current performance levels and be more costly to produce. These tradeoffs create a dilemma for the automobile manufacture. The public demand for clean air on one hand must be balanced against individual consumer demands for high performance and low cost while meeting EPA standards. Several attempts over the years have been made in redesigning and increasing air flow and exhaust flow in the internal combustion engine by avoiding tulip valves. These replacement valves are rotary valves are spherical valves with apertures therethrough for intake and exhaust purposes. However, the main problem which has not been solved is to how to seal a valve when it is closed. A spinning valve or rotating valve avoids many of the design weaknesses of the poppet valve. Spherical assembly that rotates in a timed sequence to the exposed intake in the exhaust ports have been brought forth which afford in a calculated percentage gain in fuel efficiency alone with corresponding increases in power while eliminating the can shaft and its auxiliary mechanisms. The deficiencies of the poppet valve need to be replaced. By design, the necessary use of a cam shaft to open and close a poppet valve requires that the clearance between the cam, tappet, and valve must be taken up slowly and the valve lifted slowly at first to avoid unacceptable levels of noise and wear. The valve cannot be closed abruptly or it will be bounce on its seat. Other problems are represented by the slow response time when measured in degrees of the crank shaft arc of a rotation creates losses, since the intake valve is not opened far enough to take full advantage of the low pressure created in the bore as the pistons travels downward towards the bottom dead center. To compensate for this, it is customary to open the intake valve prior to the piston reaching top dead center from the beginning of the intake stroke. Exhaust port concerns are aided by the high pressure in relating to the exhaust manifold during blow down and share the same obstacles, requiring earlier opening and late closing with a period of overlap when both valves are open. The poppet valve is a great liability to the engine beyond its flow limitations. The energy that is used to expand against the piston and turn the crank shaft is wasted during overlap and prerequisite time required to open the valve prematurely and delay their closing. The power consumed internally by an engine accounts for frictional losses, and the poppet valve train is a major offender. Additional internal friction is created by the water and oil pumps along with the crank shafts traveling through the oil pan. The friction is usually established by measuring dinotesting where the engine is run by a large electric motor without any combustion, measuring the power required to turn same. The first internal combustion engine was approximately twenty percent or less thermally efficient, with the best designs today approaching only twenty four percent. This means that 76% of the energy from the fuel consumed is going either out the tailpipe or into the cooling system and is being wasted.

What is needed to meet the technical requirements of today's internal combustion engine ie. four stroke engines or diesel engines are the results of society and federal government demand for lower emission engines which is compact, lightweight and produces increased output per liter of fuel without increasing cost. A small displacement version internal combustion engine could match all current performance levels and allow any cost savings from that engine to offset cost increase incurred by other field conserving measures. The four stroke internal combustion engine must change to survive and society demands that it survive because of cost and accessibility. In order for the four stroke internal combustion to survive, one approach will be a radical change in its head and valve design, ie. reducing friction inefficiencies and opening the valve passage as is achievable with a rotating spherical head and valve the valve being a flat portion of the spherical head which achieves up to 30 or 40 percent or more of the volume of the current valve thus allowing greater intake of fresh air and exhausting a greater quantities of exhaust gas before the next combustion stroke.

SUMMARY OF THE INVENTION

The present inventive apparatus may be used in the four stroke internal combustion engine. For simplicity, the next discussion which follows, the apparatus of this invention ie. the rotating spherical head and valve is treated as an internal combustion engine application. Even though other applications of such a mechanism can be had without undue new designs in engineering. In the fourstroke combustion engine whether it be gas or diesel, sparkplug or injected, air is rammed in through with the fuel mixture through an inlet port. In the case of diesel engines, fuel is introduced through an injector to meet with the air mixture. It should be noted that compressed air can be ported into the combustion chamber prior to injecting fuel into the chamber by means of turbo charging or super charging. If the air pressure is high enough, the engine can act as a diesel.

The present invention is an internal combustion engine having one or more cylinders each containing a reciprocating piston connected to a rotating crank shaft. A rotating spherical head and valve is located over the top of the cylinders for rotating about an axis perpendicuar to the axis of the cylinders. The rotating spherical head includes an intake passage directing air into the cylinders and the same passage upon rotation of the spherical head acts as exhaust passage for exhausting combustion gasses through the cylinders. The intake passage and exhaust passage in the rotary spherical head and valve communicate with each cylinder in succession as the rotating spherical head and valve rotates, allowing the use of a single valve opening for the cylinder. Fuels are disposed around each rotating spherical head and valve seat against the bottom surface of the rotating head to prevent the escape of combustion gasses from the cylinder. In another embodiment, the same rotating spherical head and valve has an upper seal which seals the same against the intake manifold and exhaust manifolds to disallow a mixture of either the intake gasses or the exhaust gasses.

In another aspect of the invention, a spark plug or other ignition device or injection is mounted in the combustion cylinder. A fuel injector can be mounted in the combustion cylinder for injecting fuel into the cylinder. Locating the injector in the cylinder can be a different case, that fit the need of the particular custom and rotating spherical head and valve mechanism which stratifies the charge useful for lean burn conditions. The injector can be placed just behind the intake port or in the intake passage, allowing injection of fuel during the compression or intake strokes.

It is an object of the present invention to provide a rotating spherical head and valve engine which has higher volumetric efficiencies as compared to conventional poppet valve engines. It is another object of the present invention to provide a rotating spherical head and valve engine which reduces friction losses as compared to conventional poppet valve engines. Yet another object of the present invention is to provide a rotating spherical head and valve engine which greatly reduces exhaust emissions.

Another object of the present invention is to provide a rotating spherical head and valve engine having relative small number of moving components.

Still another object of the present invention is to provide a rotating spherical head and valve engine which is well suited for use with alternative fuels including methanol, ethanol, natural gas and others as well as conventional fuels such as gasoline and diesel.

Other objects and advantages of the present invention will become apparent and obvious from a study of the following description and the accompanying drawings which are merely illustrative of such invention.

DETAILED DESCRIPTION OF THE INVENTION

Figure 2:
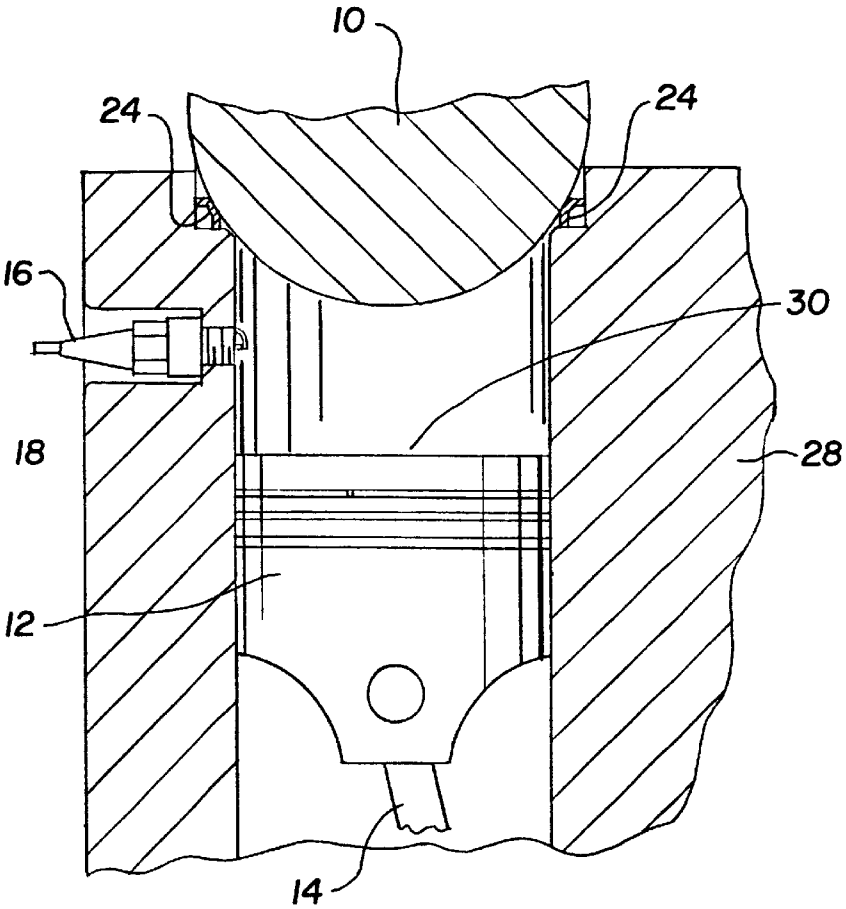
FIG. 2 is a cut away sectional side view of an internal combustion cylinder, piston and spherical head.
Figure 1:
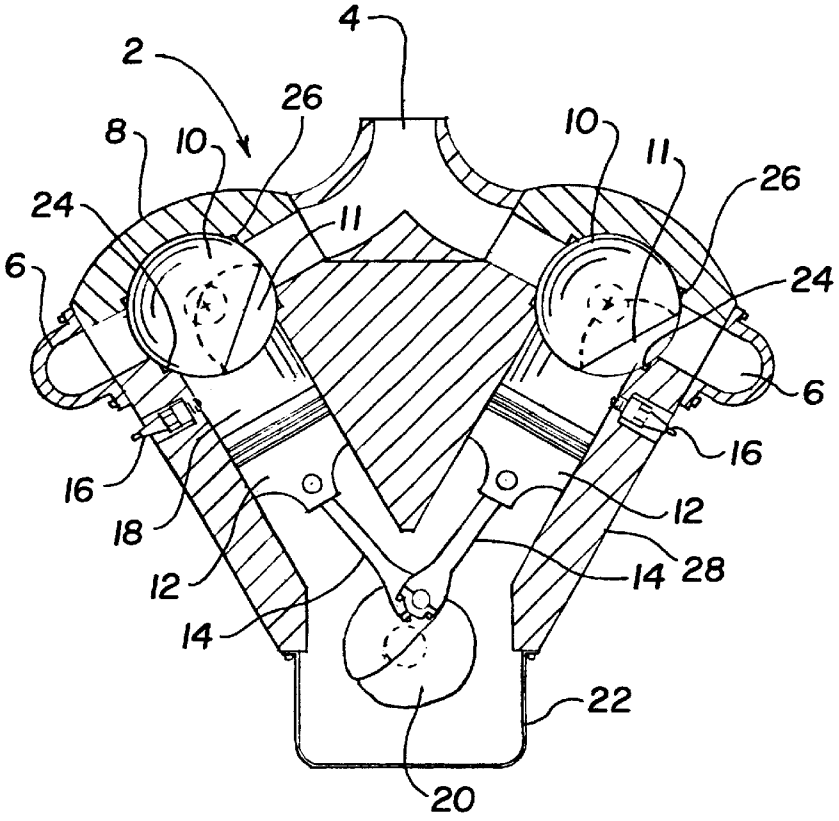
FIG. 1 is a cut away end view of a multi cylinder internal combustion, V-shaped engine employing the rotating spherical head and valve.

Referring now to the drawings, the rotating spherical head and valve engine of the present invention is shown therein and indicated generally by the number 2. The V-shaped combustion engine 2 has a rotating spherical head and valve 10 with an air intake manifold 4 and exhaust manifold 6. The engine has a manifold cover 8 which communicates with valve opening 11. Valve opening 11 is a portion of the sphere or circle which is straight or hollowed out for increased air intake or exhaust purposes. The spherical head and valve allows much greater breathing of an internal combustion engine or any machine using valving and pistons. Time that the valve is open is much longer than a spherical valve drilled through the center of a sphere or poppet valves. The combustion four engine communicates directly with pistons 12 through rods 14 to a crank shaft 20. At least one piston 12 is reciprocating in cylinder bore 18 and is ignited by spark plug 16 or through injector means and compression emission for diesel engines. Oil is maintained for lubricating purposes of the engine in oil pan 22. The rotating spherical head and valve has a lower gasket comprised of ceramic graphite materials, present day piston ring materials or ceramic technology or any other suitable technology which can be exposed to the temperatures of combustion and the rotating spherical head. The rotating spherical head has an upper gasket 26 which is also made of high temperature gasket materials and longetivity materials such as ceramics or carbon fiber or other suitable ring tight materials. The upper gasket 26 prevents air intake from communicating with exhaust gas ports of the rotating spherical head and valve. The cylinder bore 18 is defined by engine block 28 with reciprocating piston 12 having a piston head 30 which may be flat or indented for swirled combustion effect.

The cutaway in section side view of the internal combustion cylinder piston and spherical valve is shown in FIG. 2.

Also included in FIG. 2 is either placement for spark plug or injector 16 in the combustion chamber defined by piston head 30 and spherical head and valve 10. Not shown is that flat portion of the spherical head which acts as the valve opening for both air intake and up on rotation exhausting of exhaust gasses.

Figure 3:
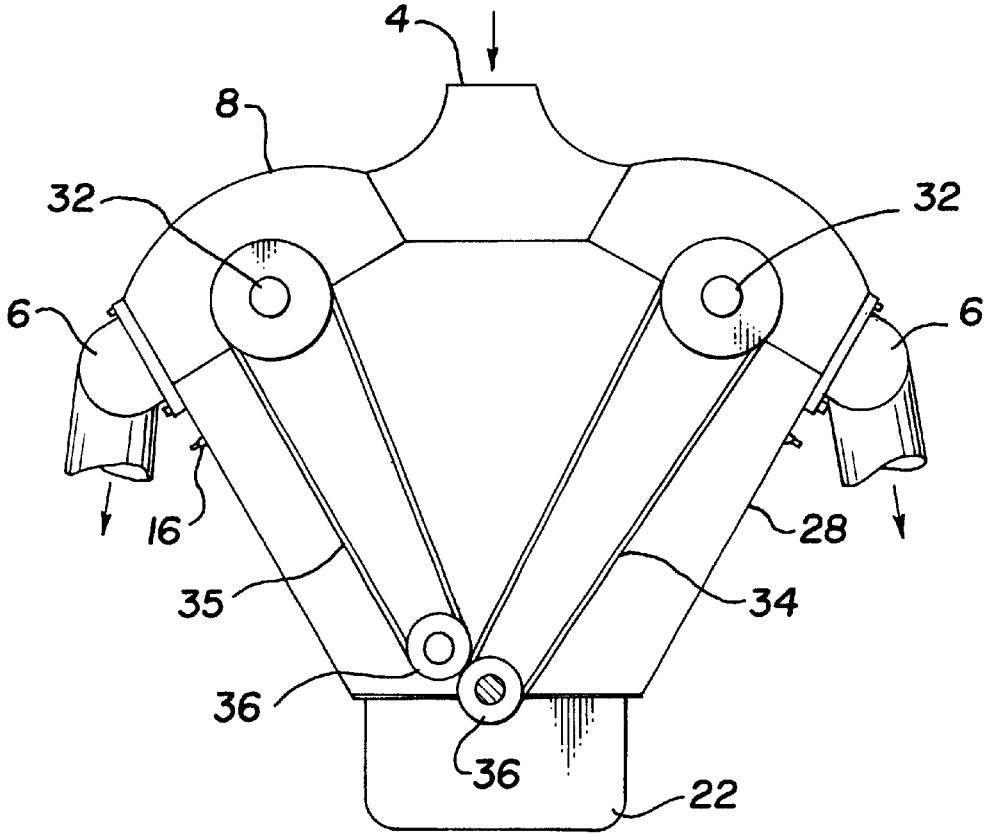
FIG. 3 is a simplified end view of a V-shaped internal combustion engine (four stroke) showing a rotating spherical head and valve train drive means.
Figure 4:
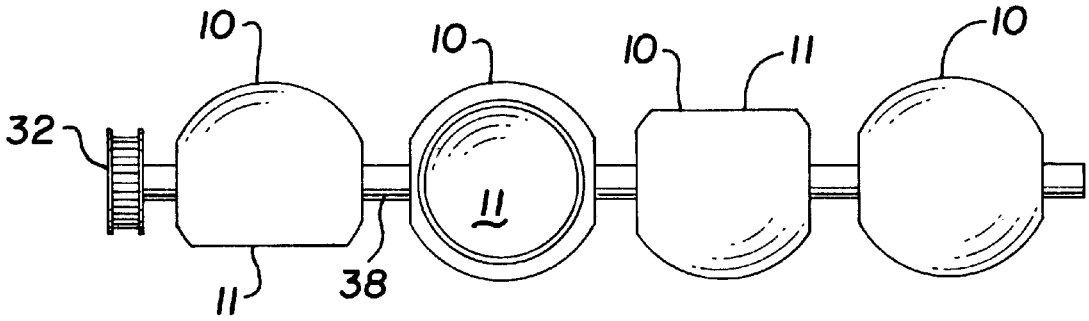
FIG. 4 is an isolated view of the rotating spherical head and valve access shaft, said shaft having four spherical rotating head and valve mechanisms in axial alignment and a drive means on one end.

In FIG. 3 a simplified end view of a V-shaped internal combustion, four cycle engine, showing rotational spherical head and valve with chain drive means 34. The rotating spherical head and valve axis 32 is a point of rotation of the spherical head and valve through crank shaft drive gears 36 and chain drive means 34 and 35. In FIG. 4, the isolated view of the rotating spherical head and valve shows an axis shaft 38 which connects the rotating spherical heads and valves on shaft 38 and effects timing means wherein the rotating spherical head and valve 10 has a flat portion which defines valve opening 11 in various timing arrangements. The rotating spherical head and valve of FIG. 4 also has second and opposing third flattened portions which are basically perpendicular to that flattened portion which acts as the valve opening 11. Said shaft can be mated with the various main bearings to the block and mounted thereon will be the head portion. The axial shaft 32 is driven by a chain, belt or other drive means 34. On V8 configurations, two drive gears are necessary, because intake charge must be taken in first. The axial shaft 32 will on one bank of V8 will turn clockwise axial shaft 32.

The valve opening 11 can be as high as 20–30 percent or more of the rotating spherical head therein defining a substantial volume for intake gasses to pass into the combustion cylinder and when rotated to quickly exhaust gasses after combustion. One of the most significant advantages of the rotating spherical head and valve is its ability to efficiently transport large volumes of air. Conventional poppet engines typically have effective intake to poor areas of 25 percent or less with the best engines achieving slightly higher. However, the rotating spherical head and valve allow higher RPM and more efficiency of burn in the combustion chamber thus emitting fewer emissions. The spherical head and valve increases the air intake from naturally aspirated engines to at least 100 percent or better and in the case of compressed air through super charges or turbo charges, the increased flow of air is over 100 percent or better. The intake port to bore area of the engine presented is about 100 percent or better or at least two times the best conventional poppet engines, or more modern spherical valves. Additionally, both intake exhaust passages of the rotary spherical head and valve and allow longer exposure time than the typical poppet valve and the requirements of reciprocating action of the valves. As a result, the rotating spherical head and valve offers little resistance to the flow of engine gasses enabling the valve to maintain its air transport capacity advantage. The increased air transport capacity allows the engine to achieve higher RPM levels. Increased RPM levels use a rotating spherical head and valve which are hollow thus reducing the weight of such unit. On the other hand, larger stationary engines requiring lower rpms and lower horse power can be operated with the ever increasing weight of the rotating spherical head and valve up to the point of having a solid spherical body and flat sided valve. The increased RPM using this type of rotating spherical head and valve as opposed to a typical poppet engine avoids valve float which occurs at higher RPM in racing performances. Increased output allows engine displacement to be reduced while still maintaining output levels comparable to conventional poppet engines. Further reduction displacement means the mass and friction of the piston and connecting rods allowing increasing RPMS as well as various hollowness of the rotating spherical head and valve depending on strength and materials requirements. In typical small mass produced engines of today using poppet valves, over 20 foot pounds of tarc is utilized just to operate its valve train. Other losses and small block GM engines with a solid-roller cam and high speed valve spring pressures take greater foot pounds of torc. The best designs of today using a poppet valve system only approaches about twenty five percent. This means that seventy-five percent of the energy from the fuel consumed is going either out the tailpipe or into the cooling system. The present invention will work as a one cylinder internal combustion engine or a multi inline or V-type engine configuration. The elimination of the cam shaft and its companion valve train components not only dramatically reduce the manufacturing cost but would allow for an application of specific engine block design, eliminating space required to house the cam shaft. Such changes would allow for less total engine height and lower hood lines for better visibility and aerodynamics. The only moving parts is the single shaft connecting the rotating spherical head and valves. Floating ceramic, or carbon seals for example will respond to cylinder pressure and temperature to form a very tight fit, containing the combustion gasses. The rotating spherical head and valve according to the invention allows superior service flow efficiencies from its spherical shape. With the standard four inch cylinder (ford bore), the factory poppet valve covers only 15.8% of the total bore area while the rotating spherical head and valve is measured at 30 or 40 percent or greater thus allowing at least efficiencies of airflow and exhaust flow of over at least 100 percent or better. A significant advantage is also found in the greatly improved thermal dynamic cycle. Greater air-fuel mixing, direct fuel injection, the use of compact hemispherical bowl-end-piston combustion chambers in the late introduction of hot valve areas also to reduce pre-ignition allowing compression ratios to obtain levels as high as 12-1 or greater. Also, intake air is transported through an always cool intake portion of the rotating spherical head and valve minimize charge heating along with the increase charge pressure created by the intake scoop and closing valve increasing total initial charge pressure increasing the initial charge pressure and compression ratio both increases means effective pressure, which results in greater efficiency and output. Adding the recapture of exhaust energy further improves this already highly efficient thermodynamic cycle to levels greater than conventional poppet valve engines.

The present invention may be carried out in other specific ways than those herein set forth without parting from the spirit and essential characteristics of the invention. The present embodiments are therefore to be considered in all respects as illustrative and not restrictive, and all changes coming within meaning and equivalency range of the appended claims are intended to be embraced therein.

What is claimed is:

1. A rotating spherical head and valve engine comprising:

(a) an engine block having at least one cylinder therein;

(b) a reciprocating piston in said cylinder;

(c) a crank shaft rotatably mounted to said engine block;

(d) a connecting rod connecting said piston to said crank shaft to rotate said crank shaft as a piston reciprocates in said cylinder;

(e) a rotating spherical head and valve mounted on said engine block;

(f) said rotating spherical head and valve including a generally flat surface which upon rotation of the mounted spherical body acts as the intake and exhaust valve depending on the angle of rotation with the cylinder;

(g) said rotating spherical head and valve mounted on said cylinder such that the rotating spherical head and valve seals to the top of said cylinder and is sealed to the cover of the intake exhaust manifold so that the exhaust and air intake gases do not mix;

(h) an intake passage formed in said rotating sphere side valve for directing intake air into said cylinder; and (i) an exhaust passage formed in said rotating spherical head and valve for exhausting said combustion gasses from said cylinder.

2. The rotating spherical head and valve engine of claim 1 including a plurality of cylinders and pistons equally spaced from the axis of rotation of said rotating spherical head and valve.

3. A rotating spherical head and valve engine comprising:

(a) an engine block having a combustion chamber;

(b) a drive member mounted in said combustion chamber;

(c) a crank shaft rotatably mounted to said engine block and driven by said drive member;

(d) a rotating spherical head and valve mounted on said engine block;

(e) an intake passage formed in said rotating spherical head forming one valve for directing intake air into said combustion chamber as said rotating spherical head including said valve rotates;

(f) an exhaust passage formed in said rotating spherical head for exhausting combustion gases from said combustion chamber as said spherical head rotates exposing the valve opening;

(g) a valve housing mounted on said engine block for enclosing said rotating spherical head and valve, said head and valve housing defining an inner intake chamber;

(h) the rotating spherical head and valve is mounted with a gasket where a connection is made with the cylinder opening and an upper gasket where the manifold cover is mounted on the rotating spherical head and valve;

(i) a rotating head and valve includes a flat surface of said spherical head forming such valve which is rotated through the cylinder such that the flat bottom surface of the rotating spherical head in the cylinder is followed by opening said flat surface into the intake manifold and further rotated around the rotation of the sphere to again reenter the cylinder in an open fashion to the exhaust manifold;

(j) a ignition means mounted in the cylinder, said fuel/air mixture in said cylinder in succession as said rotation spherical head and valve rotates through the first cycles of the internal combustion engine;

(k) a shaft connecting said head and valve in case of multi-cylinder engines and the spherical head has second and third opposing flat surfaces having access on the shaft;

(l) cooling passages extending throughout the body of said engine block such that cooling liquid or air passes through the engine block and manifold cover in which the rotating spherical head and valve are mounted; and (m) a ratio of the area of the intake and exhaust valve openings to the area of the cylinder produces at least 100% combustion improvement in air flow compared to two or more poppet valves.

4. The rotating spherical head and valve engine of claim 3 wherein said rotating spherical head and valve engine includes various cooling passages extending throughout the body of said engine block such that cooling liquid or air passes through the engine block and manifold cover in which the rotating spherical head and valve are mounted.

5. The rotating spherical head and valve engine of claim 3 including a plurality of cylinders and pistons equally spaced from the axis of rotation of said rotating spherical head and valve.

6. The rotating spherical head and valve engine of claim 3 wherein the rotating head and valve includes a concave surface of said spherical head forming such valve which is rotated through the cylinder such that the concave bottom surface of the rotating spherical head in the cylinder is followed by opening said concave surface into the intake manifold and further rotated around the rotation of the sphere to again reenter the cylinder in an open fashion to the exhaust manifold.

7. The rotating spherical head and valve engine of claim 3 wherein the spherical head and valve is hollow yet retains sufficient thickness of walls to satisfy strength requirements.

8. The rotating spherical head and valve engine of claim 3 wherein said ignition means comprises a spark plug mounted in said combustion cylinder for igniting said fuel and air mixture which is inserted in said cylinder in succession as said valve rotates and ignites said mixture by compression.

9. The rotating spherical head and valve engine of claim 3 wherein said ignition means comprises a spark plug mounted in the cylinder, said fuel/air mixture in said cylinder in succession as said rotation spherical head and valve rates through the first cycles of the internal combustion engine.

* * * * *